United States Patent [19]

Zweifel et al.

[11] 3,963,591

[45] June 15, 1976

[54] METHOD OF COLORING OF ANODIZED ALUMINUM AND ALUMINUM ALLOYS BY ELECTROLYTIC TREATMENT IN THE METAL SALT SOLUTIONS

[75] Inventors: Walter Zweifel, Neuhausen am Rheinfall; Fritz Schneeberger, Schaffhausen, both of Switzerland

[73] Assignee: Swiss Aluminium Ltd., Chippis, Switzerland

[22] Filed: Aug. 25, 1975

[21] Appl. No.: 607,250

Related U.S. Application Data

[63] Continuation of Ser. No. 411,437, Oct. 31, 1973, abandoned, which is a continuation of Ser. No. 262,009, June 12, 1972, abandoned.

[30] Foreign Application Priority Data

June 17, 1971 Switzerland ..... 8845/71

[52] U.S. Cl. ..... 204/35 N

[51] Int. Cl.[2] ..... C25D 11/18

[58] Field of Search ..... 204/35 N

[56] References Cited

UNITED STATES PATENTS 3,787,295 1/1974 Endinger et al. ..... 204/35 N

FOREIGN PATENTS OR APPLICATIONS 286,056 11/1970 Austria

*Primary Examiner*—R. L. Andrews

*Attorney, Agent, or Firm*—Ernest F. Marmorek

[57] ABSTRACT

The present invention relates to an improvement of the method for electrolytic coloring of anodically produced oxide layers on aluminum and its alloys, by electrolytic treatment in a metal salt (Ni, Co, Cu) solution. It is characterized in that one establishes in the coloring electrolyte a content of 0.02 to 0.75 grams copper per liter. The method permit uniform and reproductible coloring to be undertaken in a simple manner.

10 Claims, No Drawings

METHOD OF COLORING OF ANODIZED ALUMINUM AND ALUMINUM ALLOYS BY ELECTROLYTIC TREATMENT IN THE METAL SALT SOLUTIONS

This is a continuation of application Ser. No. 411,437, filed Oct. 31, 1973, which is a continuation of Ser. No. 262,009, filed June 12, 1972, both now abandoned.

The demand for light-resistant coloured anodised aluminum has risen in the past years. This has led to introduction of various methods for production of self coloured or coloured anodic layers.

The present invention relates to an improvement of the method for electrolytic colouring of anodically produced oxide layers on aluminum and aluminum alloys.

Electrolytic colouring in metal salt solution in known as a fundamental method since the year 1936 from the Italian patent specification No. 339 232. Recently a succession of developments of this method have been published. For example baths containing nickel salt have attained practical significance.

These known methods for electrolytic metal salt colouring often exhibit in industrial employment the disadvantage that it is difficult to produce reproducible depths of colour, so that either colouring irregularities, e.g. darker peripheral zones, appear on one and the same sheet, or variations in colour appear from piece to piece. Hitherto attempts have been made to solve the problem of irregularity of colouring by various means, for example by selection of special switching procedures for the colouring voltage, such as current pulsation at the beginning of colouring, by darker colouring with subsequent electrolytic removal of colouring, or introduction of mixtures of conducting or non-conducting material on the goods and/or on the opposite electrode, or by selected arrangement, shape or connection of the opposite electrodes. These methods are often not always certain enough for industrial use.

The present invention has set as its object, and solved, to modify the composition of the colouring bath in such a way that, in a manner which is simple in operation, uniform and reproducible colour tones can be achieved.

The method of the present invention for colouring of anodised aluminum and aluminum alloys by electrolytic treatment in a metal salt solution, which contains nickel and/or cobalt salts, as well as copper salts, permits uniform and reproducible colourings to be undertaken in a simple manner and is characterised in that one establishes in the colouring electrolyte a content of 0.02 to 0.75 grams copper per liter, added in the form of copper salts.

According to a preffered way of carrying out the present invention, one establishes in the colouring electrolyte a content of 0.02 to 0.4 grams copper per liter. Copper sulphate is a suitable copper salt for the method of the present invention. Advantageously one maintains for example in the colouring bath a content of 0.1 to 1.0 grams copper sulphate ($CuSo_4.5H_2O$) per liter.

In the method according to the invention it is scarcely critical what anions are added with the copper salt to the colouring elctrolyte, so long as the colouring ability itself of the electrolyte is not influenced and the latter is stable.

EXAMPLE 1

An aluminum sheet 1.000 by 2.000 by 2 mm of AlMg alloy with 1.5% magnesium was anodised to an oxide layer thickness of 17 um in direct current method (170g/l $H_2SO_4$, temperature 18°C, 1.5a/dm$^2$ during 40 minutes). The sheet was rinsed in cold running water and thereafter was coloured during 10 minutes with 12 volts AC in an electrolyte consisting of:

30 g/l nickel sulphate ($NiSO_4.6\ H_2O$)

30 g/l boric acid ($H_3BO_3$)

After the colouring the sheet showed a middle bronze colour with darker peripheral zones.

EXAMPLE 2

An aluminum sheet, 1,000 by 2,000 by 2 mm, of AlMg alloy with 1.5% magnesium was anodised to an oxide layer thickness of 17 um by DC method (170g/l $H_2SO_4$, temperature 18°C, 1.5a/dm$^2$during 40 minutes). The sheet was rinsed in cold running water, and thereafter was coloured during 10 minutes with 12 volts AC in an electrolyte consisting of:

30 g/l nickel sulphate ($NiSO_4.6\ H_2O$)

30 g/l boric acid ($H_3BO_3$)

0.5 g/l copper sulphate ($CuSO_4.5\ H_2O$)

After the colouring the sheet showed a uniform middle bronze colour. Upon repetition of the anodising and colouring on a second sheet of the same alloy the same middle bronze colour was obtained under identical conditions, without a reddish tinge thereupon appearing.

In an Austrian patent specification there has indeed been described a method according to which anodically oxidised objects can be coloured with employment of electrolytes containing nickel or cobalt salts, as well as boric acid and potassium salts of multi-basic sulphonic acids, which also contains a further 5 to 100 g, advantageously 10g copper sulphate per liter of solution, in two series of colours at will by employment of different electrical conditions, namely in a red serie and a bronze serie, where the copper content is fundamental for the production of the red system and the nickel or cobalt content for the bronze system. A disadvantage of each method with the range of the copper addition there to be maintained is that the bronze colouring is never pure, but always reddish tinged.

The present invention is not intended for the production of a two colours scale, but for the improvement of the uniformity and regularity within the series of colours obtainable in colouring solutions containing nickel and/or cobalt salts from light bronze through middle bronze, dark bronze to black, and indeed without therein any reddish tinge appearing. It employs additions of copper salt in significantly different ranges of concentration from any method of the Austrian patent specification with production of certainly reproducible new technical effects, which consist exactly in the fact that thereby all reddish tinge is avoided, quite apart from the uniformity of colouring achieved. The technical teaching of the present invention and the technical effect to by thereby achieved are thus not to be understood from any Austrian patent specification.

What is claimed is:

1. In an improved method for coloring anodically produced oxide layers on aluminum and aluminum alloys by electrolytic treatment in a metal salt solution electrolyte containing nickel salts and/or cobalt salts and being operable to obtain bronze colorations normally obtained in said oxide layers with the use of said salts, the steps comprising adding a quantity of copper salt such as to establish, in the solution, a concentration of about 0.02 to about 0.75 grams of copper per liter of solution, said concentration being sufficiently large to promote uniformity of color and sufficiently small to restrain the occurrence of reddish tint normally associated with the presence of copper ions in said electrolyte.

2. The method as claimed in claim 1, wherein the solution content is from 0.02 to 0.4 grams of copper per liter.

3. The method as claimed in claim 2, wherein the copper salt is copper sulphate.

4. The method as claimed in claim 1, wherein the copper salt is copper sulphate.

5. The method as claimed in claim 1, wherein the solution content of the copper salt is from 0.1 to 1.0 grams of copper sulphate ($CuSO_4.5H_2O$) per liter.

6. The method as claimed in claim 1, wherein the electrolytic treatment comprises using alternating current.

7. The method as claimed in claim 1, wherein the bronze colorations obtained are light bronze colorations.

8. The method as claimed in claim 1, wherein the bronze colorations obtained are middle bronze colorations.

9. The method as claimed in claim 1, wherein the bronze colorations obtained are dark bronze colorations.

10. The method as claimed in claim 1, wherein the bronze colorations obtained are so dark as to appear black.

* * * * *